US006684576B2

(12) United States Patent
Grandin

(10) Patent No.: US 6,684,576 B2
(45) Date of Patent: Feb. 3, 2004

(54) MODULAR SERVICE BAR

(76) Inventor: Mark S. Grandin, 2574 Park St., Jacksonville, FL (US) 32204

( * ) Notice: Subject to any disclaimer, the term of this patent is extended or adjusted under 35 U.S.C. 154(b) by 85 days.

(21) Appl. No.: 09/945,579

(22) Filed: Sep. 4, 2001

(65) Prior Publication Data

US 2003/0041529 A1 Mar. 6, 2003

(51) Int. Cl.[7] ..... A47F 10/00

(52) U.S. Cl. ..... 52/36.1; 52/474; 52/483.1; 108/60

(58) Field of Search ..... 52/36.1, 481.2, 52/716.4, 716.8, 718.01; 108/27, 157.16, 50.02; 312/140.1, 140.2, 195, 265.1, 265.4, 265.5, 351.4; 248/903

(56) References Cited

U.S. PATENT DOCUMENTS 795,957 A * 8/1905 Cartland ..... 108/157.16
2,599,909 A * 6/1952 George ..... 186/67
3,532,403 A * 10/1970 Koski ..... 52/36.1
5,237,935 A * 8/1993 Newhouse et al. ..... 108/50
5,640,912 A * 6/1997 Diffrient ..... 108/50
6,202,567 B1 * 3/2001 Funk et al. ..... 108/50.02

* cited by examiner

*Primary Examiner*—Carl D. Friedman
*Assistant Examiner*—Naoko Slack
(74) *Attorney, Agent, or Firm*—Arthur G. Yeager

(57) ABSTRACT

A modular and versatile food and beverage service bar requiring minimum storing space and enabling service of large number of people in social and theme events and readily changeable to meet variety of décor needs, includes a plurality of full sections, each section includes three spaced U-shaped box support members having an upper horizontal member, an upright vertical member and a lower horizontal member, a rigid top plate secured to the upper members, a pair of trim bands secured to the upright vertical members and sandwiching a front panel against and generally covering the upright vertical members, and fasteners in the form of bolts and nuts to couple these components together. Another embodiment of the present invention is a half section including a pair of spaced support members as well as a rigid top plate, a pair of bands and a front bendable panel.

24 Claims, 7 Drawing Sheets

MODULAR SERVICE BAR

CROSS REFERENCE TO RELATED APPLICATIONS

Not Applicable

FEEDERALLY SPONSORED RESEARCH

Not Applicable

BACKGROUND OF THE INVENTION

1. Field of the Invention

The present invention relates to a modular food and beverage service bar that can be readily assembled and disassembled and easily changed according to desired design needs.

2. Related Art

Portable food and beverage service bars are well known in the prior art. A typical bar is a tall and narrow rolling cart that provides enough space for one bartender to serve one person at a time. There are several problems with the typical bar. The bar is non-modular and cannot be reduced in size for storing. Occasionally, long lines of people will be waiting to be served by one bartender one person at a time since the inside bar space accommodates only one bartender. An additional problem is the lack of versatility with respect to decor needs relating to corporate events, special meetings or theme events. Consequently, the industry resorts to building customized theme bars, which consumes significant resources and can only be used for one theme event.

Because of these problems with the prior art, it is apparent that there is a need for an improved and modified portable food and beverage service bar.

It is an object of the present invention to provide for a modular service bar that can be readily reassembled and disassembled repeatedly.

It is another object of the present invention to provide for a service bar that requires minimum storage space.

It is a further object of the present invention to provide for a service bar that has enough space to enable multiple bartenders to serve many people at a time and thus fostering social interaction between participants of social events.

It is an additional object of the present invention to provide for service bar that readily changeable décor as desired to fit a variety of different social and corporate themes.

Yet, it is another object of the invention to provide for a service bar section kit that can be easily assembled into a food and beverage service bar and disassembled again into a bar section kit.

BRIEF SUMMARY OF THE INVENTION

A modular service bar includes a plurality of interchangeable sections, which can be readily connected to each other. Each section includes a plurality of spaced U-shaped aluminum box support members and each support member has an outer wall, an inner wall and a pair of side walls juxtaposed to form a lower horizontal box member, an elongated upright vertical box member and an upper horizontal box member. The upright member at its lower end is rigidly connected to the lower member, and the upper member is rigidly connected to an upper end of the upright member. The bar further includes a rectangular front panel for each section that has a top horizontal edge, a bottom horizontal edge, a proximal vertical edge and a distal vertical edge. The panel is generally overlying and covering the upright support members. The front panel has a front surface and a back surface juxtaposed to the outer wall of the upright support members, and the front panel is detachably affixed to the upright support members. The bar also includes a top plate that has a curved inner and outer edges, a top surface and a bottom surface juxtaposed to the outer wall of the upper support member and the top plate is detachably affixed to the upper support member.

The modular bar further includes a pair of trim bands sandwiching the front panel between them to enable readily replacement of the front panel to fit different decor needs. One of the trim band being disposed adjacent the bottom edge of the front panel and is fastened to the upright support members. The other trim band is disposed adjacent the top horizontal edge and is fastened to the upright support members.

Each of the support members includes a gusset positioned and affixed to and between the lower member and the upright member. Another gusset is positioned and affixed to and between the upper member and the upright member. The upper member includes a pair of knobs for supporting the top plate, which extends upwardly from the outer wall of the upper member to the bottom surface of the top plate.

In one embodiment of the present invention, the front panel is fastened to three spaced support members, a first support member positioned at the proximal vertical edge, a second support member positioned at the distal vertical edge, and a third support member positioned midway of the front panel.

Each section is placed adjacent to another section so that one support member at the proximal vertical edge of a first section is detachably connected to another support member at the distal vertical edge of a second section, and another support member at the distal vertical edge of the first section is adapted to be detachably connected to a further support member at the proximal vertical edge of the further identical section.

A plurality of sections can be arranged to form a variety of arrangements such as a quarter, half or full circular bar except for an egress passageway for the baretenders.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention relates to a readily assemblable and disassemblable modular food and beverage service bar, which comprises a plurality of identical sections that can be configured in a variety of arrangements, such as a full circle, half circle and quarter circle.

Figure 1:
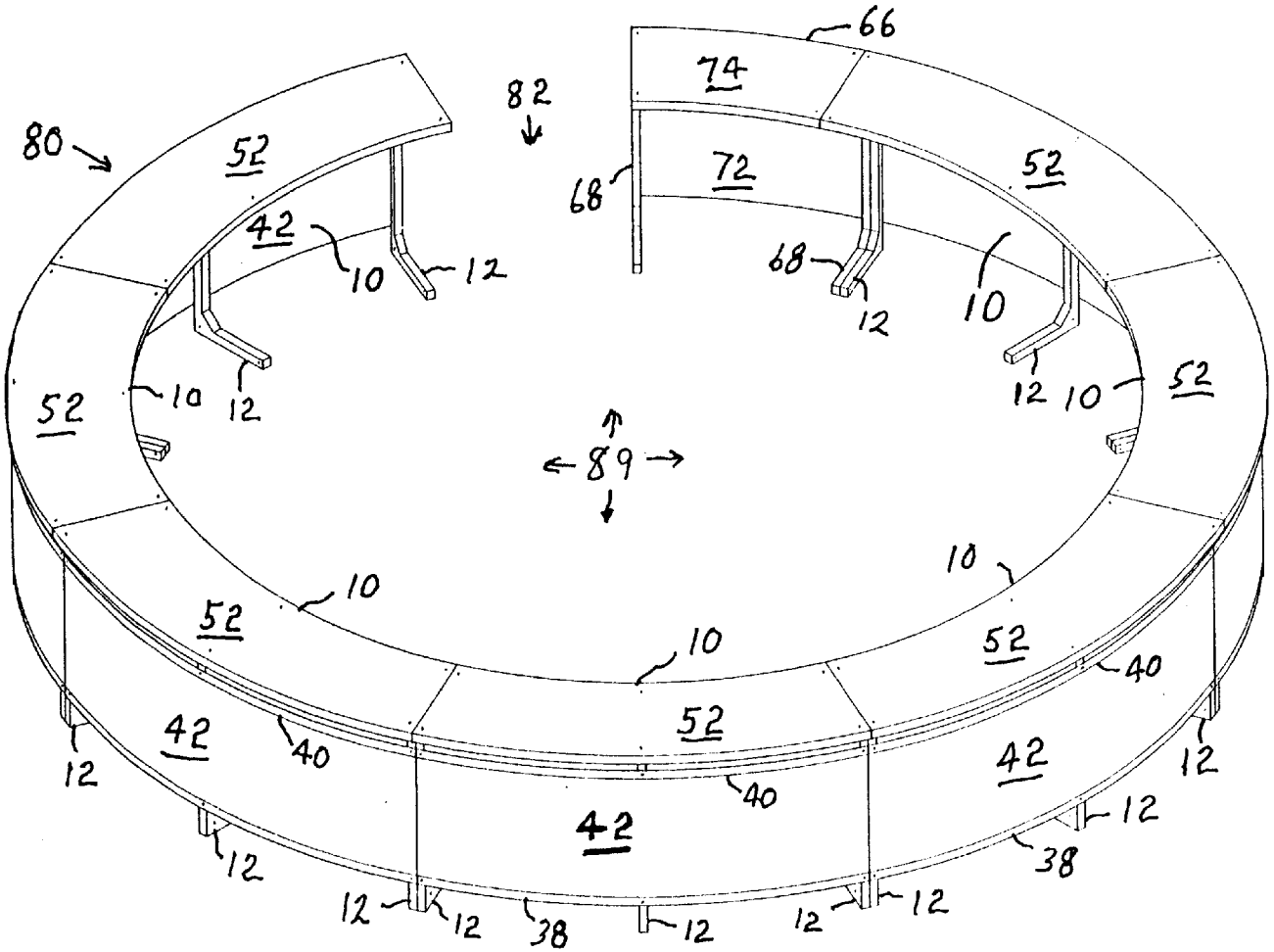
FIG. 1 illustrates a first embodiment of the modular service bar showing a full circular beverage and food bar with an egress passageway.

FIG. 1 shows a full circular service bar 80 that has seven interchangeable sections 10 and one half section 66 positioned adjacent open egress passageway 82 of the bar 80 to form a circle having an outer diameter of approximately 20 feet. The space 89 inside the bar 80 is capable of accommodating seven or more bartenders inside the bar 80 and thus enabling service of a large number of people during social or corporate-events. The scene of long lines of people around bars waiting to be served may become a past memory with the use of the present service bar.

Each of the identical sections 10 includes a composite countertop material cut into an arcuate pattern. When the sections 10 are placed adjacent each other, they form a circular service bar 80 as shown in FIG. 1. Each section 10 of the bar 80 is coupled to the adjacent section by fasteners such as an assortment of nuts and bolts, not shown in FIG. 1, and therefore can be easily separated from each other to make other configurations from the disassembled components. Each section 10 is also fabricated from several components, shown more clearly in FIGS. 2 and 3, which can be readily assembled or disassembled repeatedly to reduce storage space.

Figure 2:
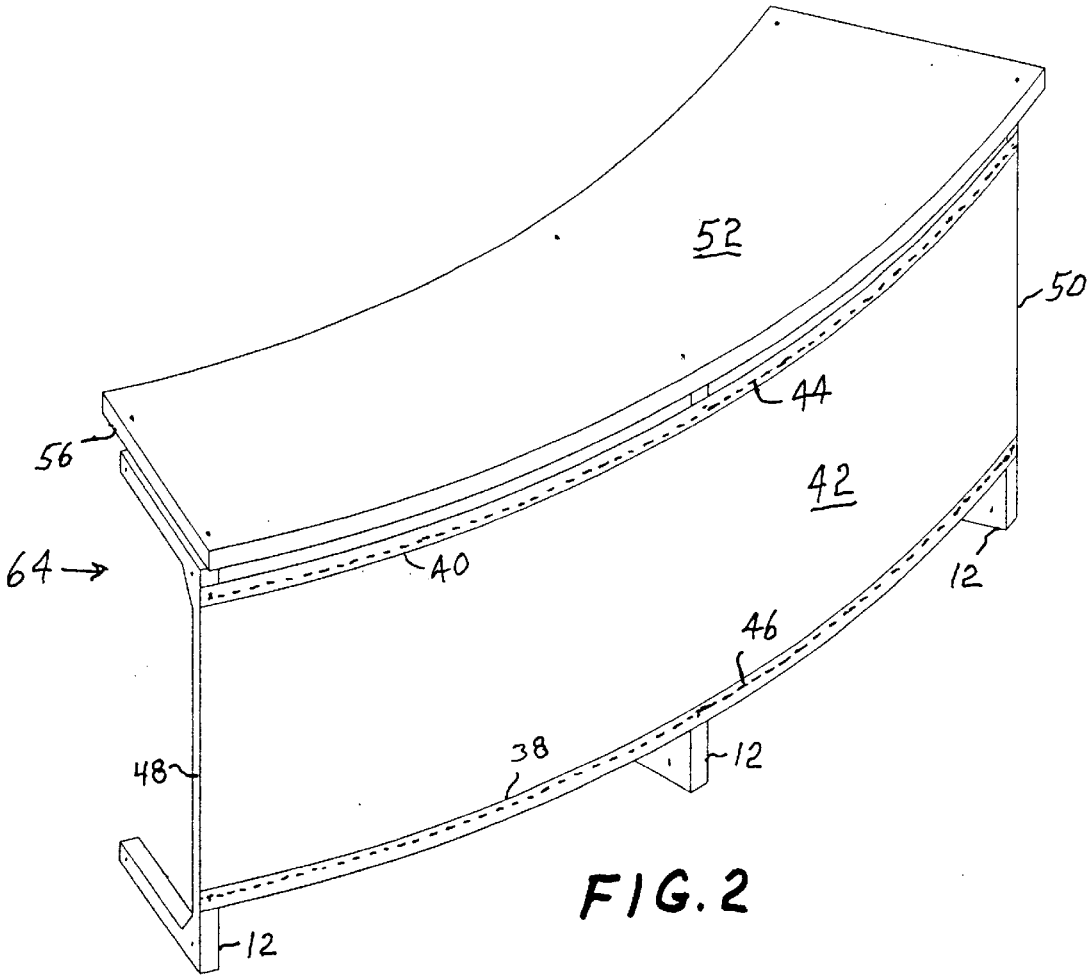
FIG. 2 is a perspective view of an assembled section of the modular service bar of FIG. 1.

FIG. 2 shows one assembled section 10 having a generally arcuate configuration and including three spaced U-shaped box support members 12 preferably constructed from 2 inch aluminum box tubing. A front panel 42 generally covers the upright member 22 of the U-shaped box support members 12 and such front panel 42 is made of a pliable material or a plastic laminate composite material capable of bending to substantially match the curvature of the top plate 52. The front panel 42 is a rectangle and includes a proximal vertical edge 48, a distal vertical edge 50, a top horizontal edge 44 and a bottom horizontal edge 46. A pair of trim bands 38 holds the front panel 42 between them. The trim bands 38 are made of thin aluminum flat bars that are pre-bent to match the curvature of the section 10 and such bands 38 provide structural rigidification and enhancement to the modular bar section 10. One band 38 is fastened to the outer wall 14 of the U-shaped box support members 12 through bolts, including bolt 37 and nut 39, and positioned adjacent the bottom horizontal edge 46 of the front panel 42, and another trim band 38 is positioned adjacent the horizontal top edge 44 to secure the front panel 42 between the bands 38 and 40. The front panel 42 may need to be trimmed to fit between the bolts, including bolt 37, which connect the bands 38 to each upright member 22.

A top curved plate 52 made of rigid countertop material is disposed on the top of the U-shaped box support members 12 wherein the bottom surface 56 of the plate 52 is fastened to the upper horizontal member 24 of the support members 12.

Figure 3:
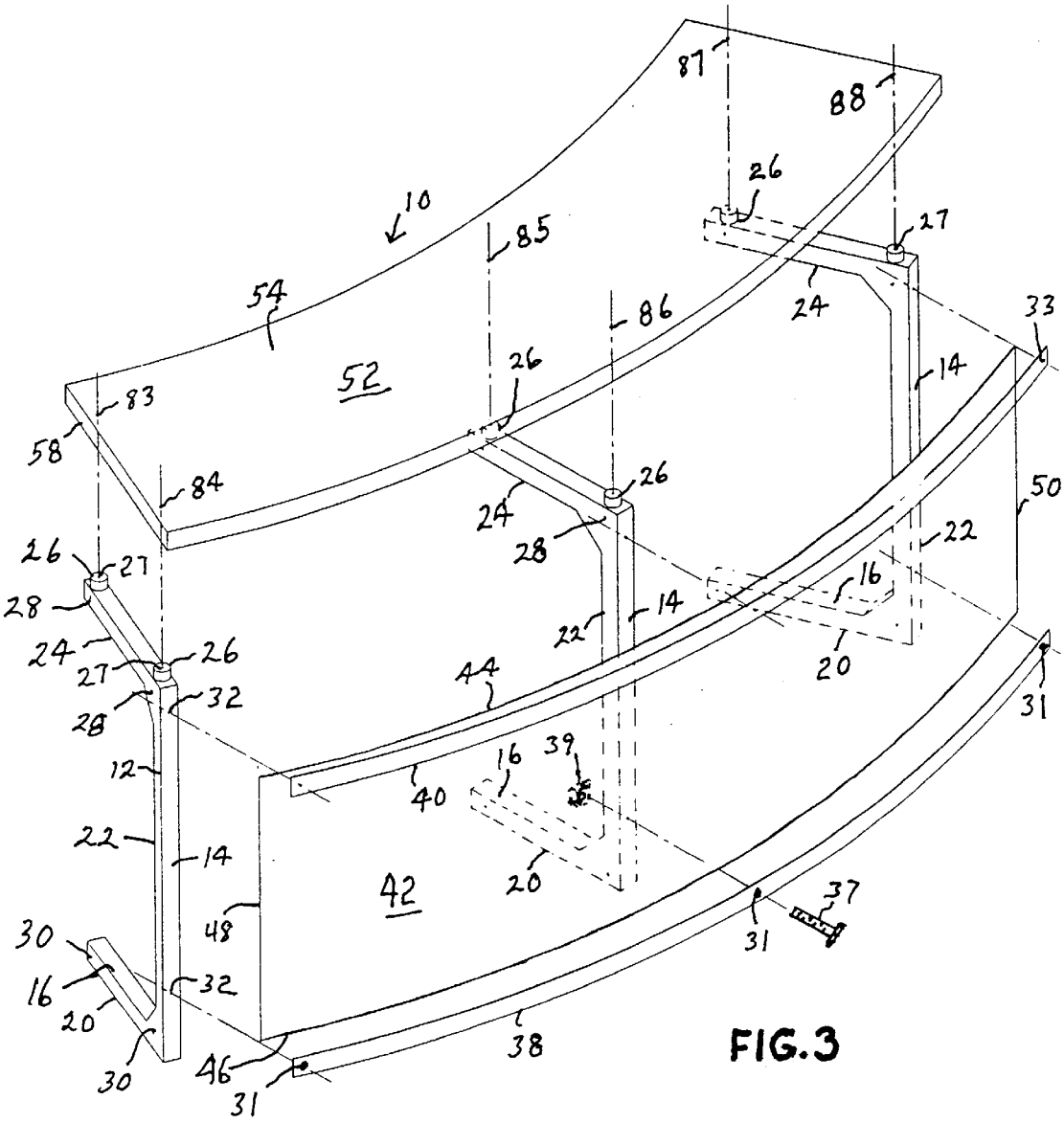
FIG. 3 is a perspective exploded view of the section of the modular service bar of FIG. 2.

FIG. 3 shows the assembly of the curved section 10 in clearer details with the front panel 42, the top plate 52, the trim bands 38 exploded away from the U-shaped box support members 12. The U-shaped support members 12 are fabricated from 2 inch aluminum hollow box tube and include an outer wall 14, an inner wall 16 and a pair of spaced side walls 18 juxtaposed to form a lower horizontal member 20, an upright vertical member 22 and an upper horizontal member 24 welded together into U-shaped outer wall 14 and a U-shaped inner wall 16. A first gusset reinforcement 34 is positioned between the lower horizontal box member 20 and the upright member 22, and another gusset reinforcement 36 is positioned between the upper horizontal member 24 and the upright member 22 and such reinforcements 34 and 36 are appropriately welded and smoothly finished. A pair of knobs 26 are secured to the outer wall 14 of the upper horizontal member 24 and have threaded vertical bores, not shown, to receive bolts, including bolt 53 through countersunk spaced openings, not shown, in plate 52 to firmly affix plate 52 to each of the support members 12. In order to couple the support members 12 to the front panel, the top panel and the adjacent sections, a plurality of apertures appropriately are bored into the support members 12 and a plurality of bolts fastened by nuts are used to readily connect the components, as well known in the art.

Figure 4A:
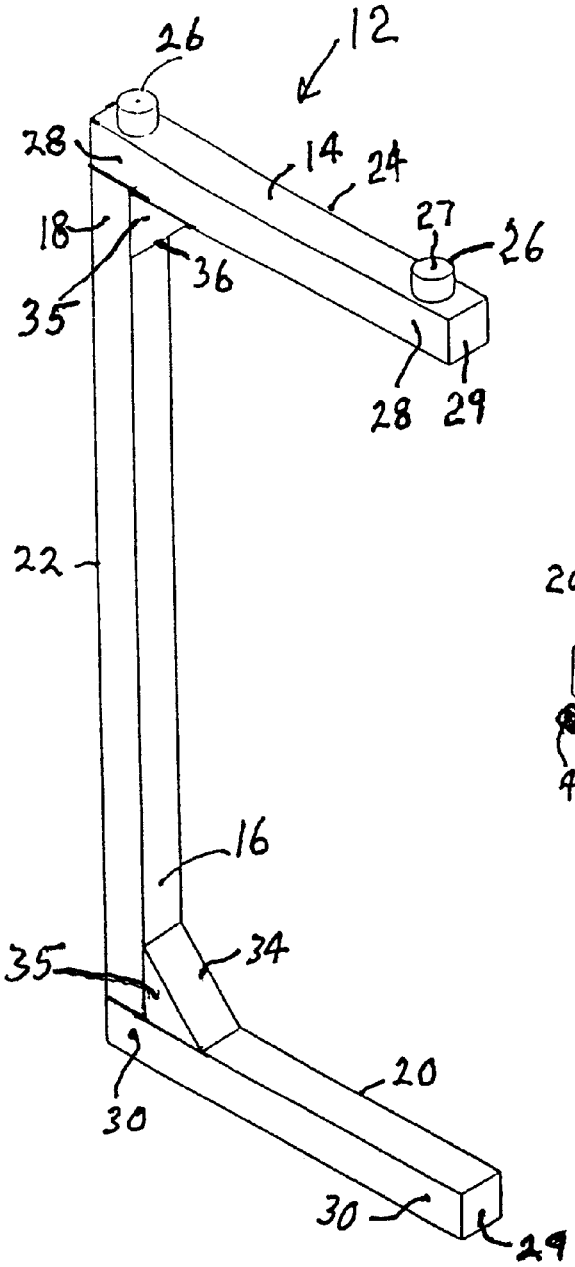
FIG. 4A is a perspective view showing a support member in accord with the present invention.

As shown in FIG. 4A, a pair of spaced apertures 30 are bored through the sidewalls 18 of the lower horizontal member 20 and are used to connect adjacent sections 10 of the service bar 80. Likewise, a pair of spaced apertures 28 are bored through the sidewalls 18 of the upper member 24 to be used to connect the upper members 24 of adjacent sections 10. An additional pair of spaced apertures 27 are bored and threaded into the pair of knobs 26 to be used to secure the top plate 52 on and to the pair of knobs 26. Each of the horizontal members 20 and 24 include end plates, including plate 29, welded to close the hollow box member. Also, the openings, not shown, formed by gusset 34 and 36 are closed by end plates, including plate 35 welded to close such openings.

Figure 4B:
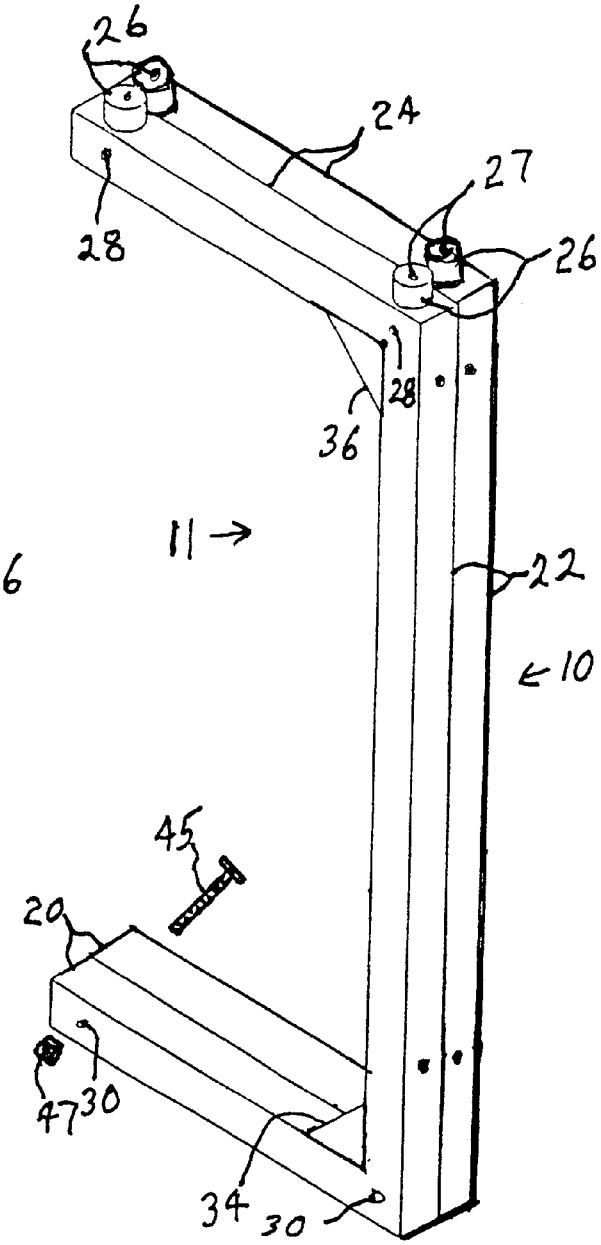
FIG. 4B is a perspective view showing two support members of two adjacent sections attached to each other.

FIG. 4B shows two support members 22 of two adjacent sections 10 and 11 attached to each other by fasteners in the from of bolts, including bolt 45, extending through bores 30 in the lower horizontal box members 20 and nuts, including nut 47 threaded thereon. Accordingly, a plurality of sections 10 adjacent each other may be readily and firmly attached to form a substantial full circle, half circle or quarter circle. If desired seven pairs of support members 22, as shown in FIG. 4B, may be pre-connected with such bolts and nuts, including bolt 45 and nut 47, to facilitate assembly of the bar 80 or its other subassemblies.

Figure 5:
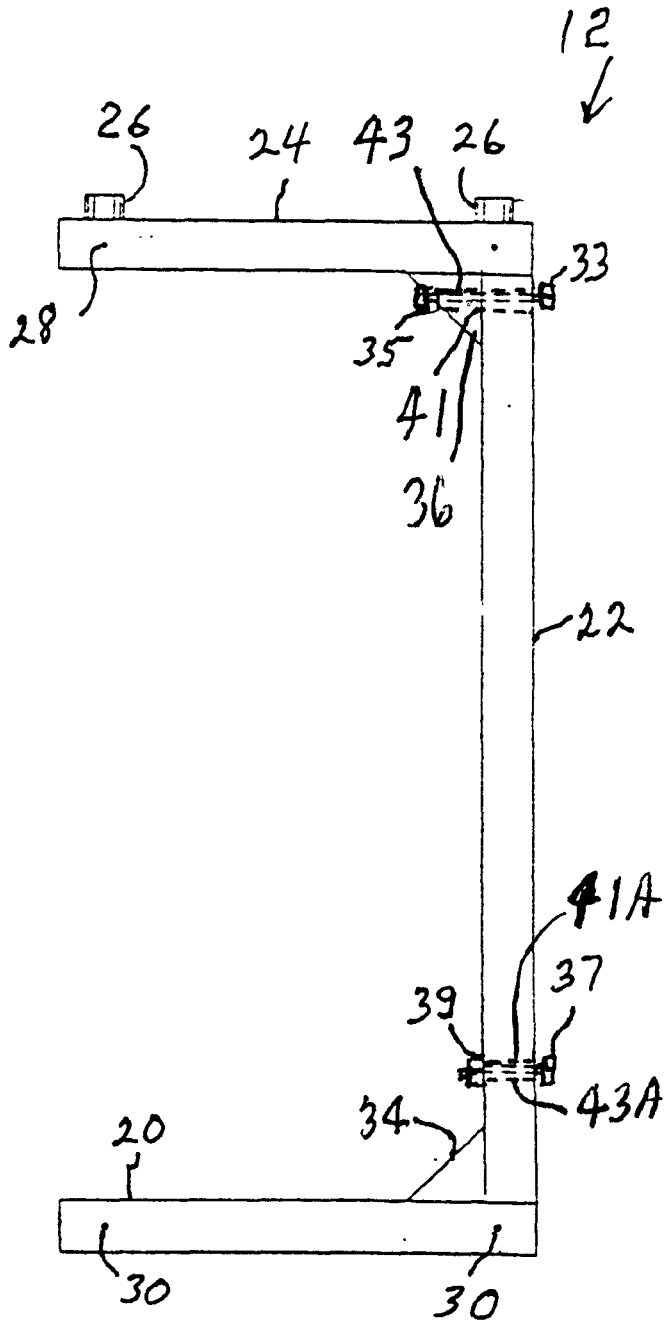
FIG. 5 is a side elevational view of the support member shown in FIGS. 4A and B.

FIG. 5 is a side view of the support member 12 showing one aperture 32 extending horizontally through the upright vertical member 22 and the gusset 36. A bolt 33 is inserted through the aperture 32 to couple the trim band 40, best shown in FIG. 3, to the support member 12, and a nut 35 secures the bolt 33. Another bolt 37 is used to couple the trim band 38, best shown in FIG. 3, to the support member 12 and is inserted through the aperture 32 located above the gusset 34 is secured by a nut 39. Since aperture 32 extends through the gusset 36 as well as the upright hollow box member 22, an aluminum cylindrical tube 41 larger in diameter than the threaded bolt 33 is welded in place to provide a passageway 43 so that the bolt 33 may be more readily positioned during assembly thereof with the other components. Tube 41 extends slightly pass the gusset 36 so that the nut 35 may tighten properly on the bolt 33. Another tube 41 may be welded within upright member 22 to provide a passageway 43A for bolt 37.

A plurality of bores are provided through the top plate 52 and trim bands 38, as illustrated in FIG. 3, in order to couple them by bolts extending through the bores 27, 28, 30 and 32 in the support members 12. In particular, three apertures 31 are bored through each trim band 38 and 40 to match bores 32 bored through the outer wall 16 of three as the bolts 33 and 37, and nuts 35 and 39 respectively, as clearly shown in FIG. 5. The front panel 42 is placed on the bolts 37 attaching the trim band 38 to the upright vertical members 22 and placed between the trim bands 38 and 40 and against the three upright members 22. The nuts 35 and 37 are tightened on bolts 33 and 37 to secure the front panel 42 in place and the trim bands 38 and 40 to the upright members 22. The process is repeated to assemble another identical section 10 and so forth. In order to disassemble the section 10, the reverse order is followed.

Figure 6:
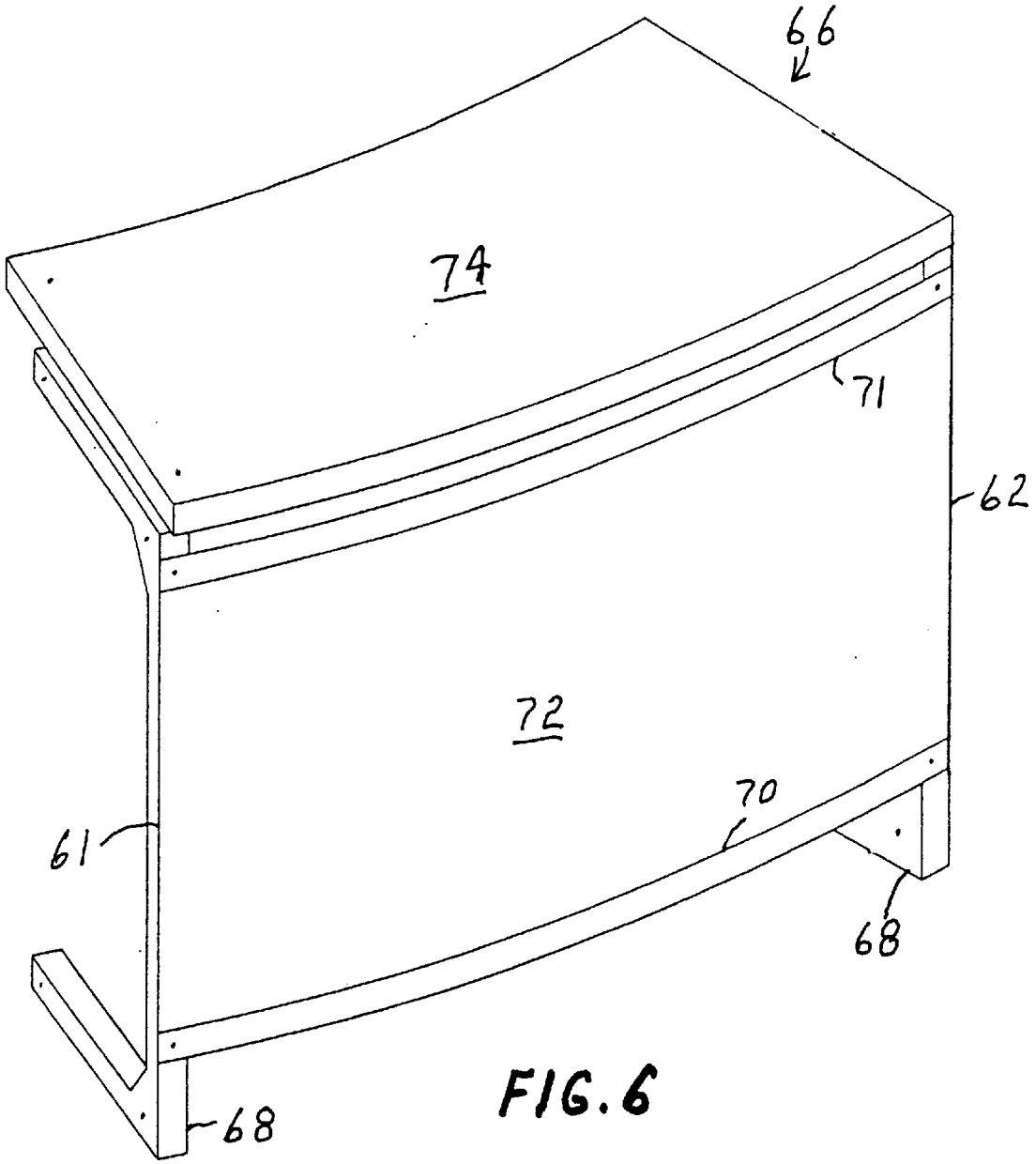
FIG. 6 is a perspective view of an assembled half section of the service bar of FIG. 1.
Figure 7:
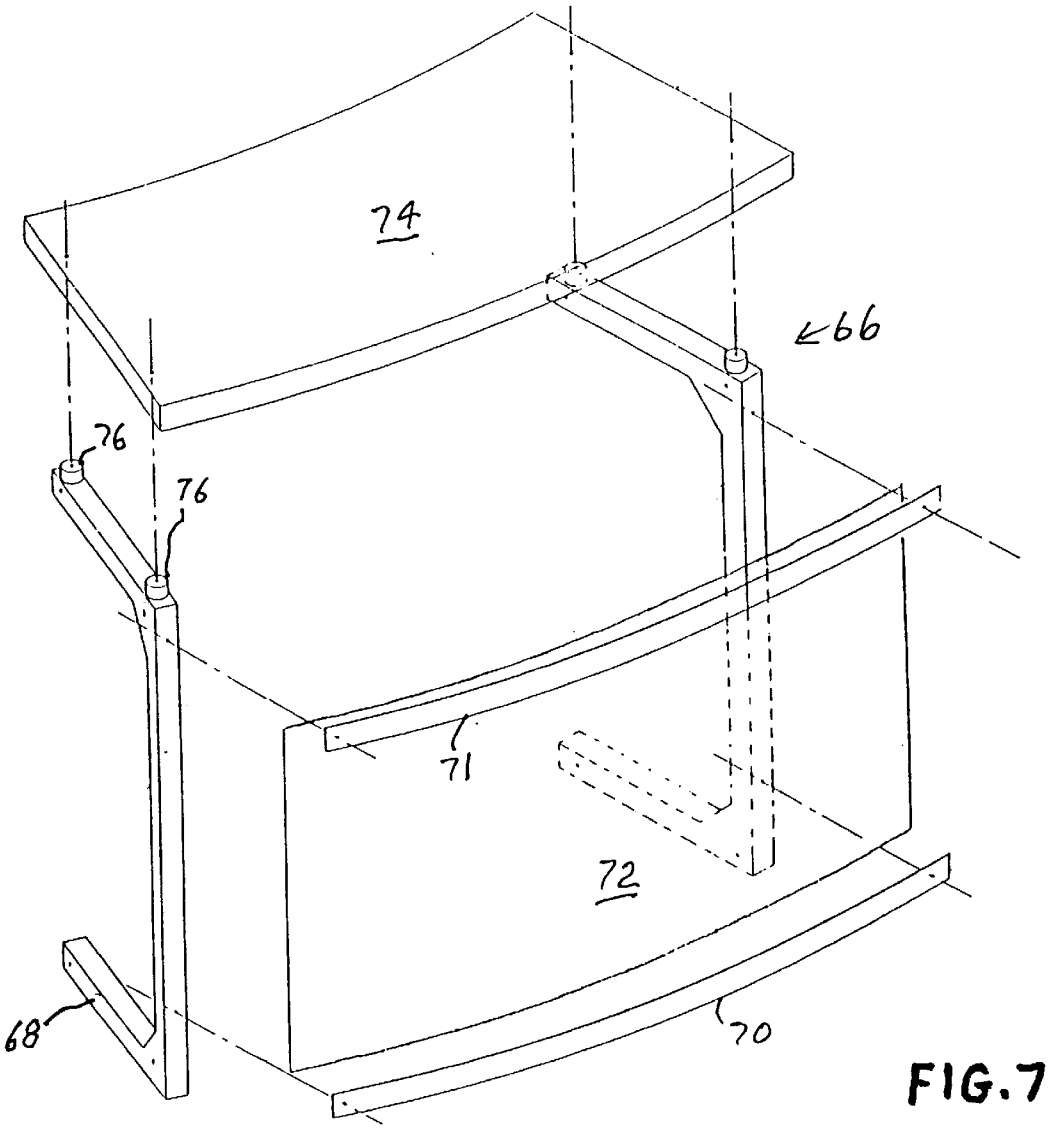
FIG. 7 is a perspective exploded view of the half section of FIG. 6.

FIG. 6 is an assembled half section 66 in accord with the present invention. The half section 66 is used primarily to create an open end path 82 to the fill circular service bar 80, shown in FIG. 1, to enable bartenders to freely enter and exit. The half section 66 may also be used to create a variety of configurations along with plurality of full sections 10. Unlike the full section 10 that has three support members 12, the half section 10 includes two spaced support members 68 positioned at proximal end 61 and distal end 62, a pair of trim bands 70 and 71 sandwiching a rectangular front panel 72 shorter than the front panel 42 of the full section 10. A smaller top plate 74 is secured to two sets of knobs 76, best shown in FIG. 7, positioned on top of the two support members 68. The disassembled and exploded half section is shown in FIG. 7. The aforementioned descriptions of FIGS. 3, 4A, 4B and 5 are generally applicable to FIGS. 6 and 7 as would be apparent to those having ordinary skill in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed and what is desired to secure by Letters Patent of the United States:

1. A modular service bar comprising a plurality of coupleable interchangeable sections, each said section including a plurality of spaced U-shaped hollow box support members, each said support member having an outer wall, an inner wall and a pair of side walls juxtaposed to form a lower horizontal box member, an elongated upright vertical box member and an upper horizontal box member, said upright member at its lower end being rigidly connected to said lower member, said upper member being rigidly connected to said lower member, said upper member being rigidly connected to an upper end of said upright member, a rectangular front panel for each section having a top horizontal edge, a bottom horizontal edge, a proximal vertical edge and a distal vertical edge, said panel generally overlying and covering said upright members, said front panel having a front surface and a back surface juxtaposed to said outer wall of said upright members, means for detachably and rigidly affixing said front panel to said upright members, said means for detachably and rigidly affixing said front panel includes a pair of trim bands, one said trim band being disposed adjacent said bottom edge of said front panel and being fastened to said upright members without passing through said front panel, and another said trim band being disposed adjacent said top horizontal edge and being fastened to said upright members without passing through said front panel, a top plate having a top surface and a bottom surface juxtaposed to said outer wall of said upper member, said top plate being detachably and rigidly affixed to each said upper member.

2. The modular bar of claim 1 wherein each said support member includes a gusset positioned and affixed to and between said lower member and said upright member, and another gusset positioned and affixed to and between said upper member and said upright member.

3. The modular bar of claim 1 wherein each said upper member includes a pair of knobs disposed and extending upwardly from said outer wall of said support member, said knobs supporting said top plate spacedly above said support member and said top plate being detachably and rigidly secured to said knobs.

4. The modular bar of claim 1 wherein each said section includes one said front panel rigidly fastened to three spaced said support members, one said support member at said proximal vertical edge, another said support member at said distal vertical edge, a third said support member positioned midway of said front panel.

5. The modular bar of claim 4 wherein one said section being adjacent to another said section, one said support member at said proximal vertical edge of one said section being detachably coupled to one said support member at said distal vertical edge of another said section, and another said support member at said distal vertical edge of one said section being adapted to be detachably coupled to a further said support member at said proximal vertical edge of a further identical section.

6. The modular bar of claim 1 wherein said plurality of sections form a substantially circular bar, each said top plate having inner and outer curved edges.

7. A portable reassembleable section of a service bar comprising a plurality of U-shaped spaced hollow box support members each having an outer wall, an inner wall and a pair of side walls juxtaposed to form a lower horizontal box member, an elongated upright vertical box member and an upper horizontal box member, said upright member at its lower end being rigidly connected to said lower member, said upper member being rigidly connected to an upper end of said upright member, said outer wall of said lower member being disposable on a horizontal surface, a front panel having a top horizontal edge, a bottom horizontal edge, a proximal vertical edge and a distal vertical edge and generally overlying and covering said upright members, said front panel having a front surface and back surface, said back surface being juxtaposed to said outer wall of said upright members, a pair of spaced trim bands on the front surface of said panel, detachable means for connecting said trim bands to each of said upright members with said panel sandwiched therebetween without passing through said front panel, a top plate having a top surface and a bottom surface, a front side edge and a rear side edge, said bottom surface of said plate being supported on and rigidly coupled to said outer wall of said upper members.

8. The section of claim 7 wherein each said support member includes a gusset positioned and affixed to and between said lower member and said upright member, and another gusset positioned and affixed to and between said upper member and said upright member.

9. The section of claim 7 wherein said upper member includes a pair of knobs disposed and extending upwardly from said outer wall of said member, said knobs supporting said top plate and being detachably and rigidly secured thereto.

10. The section of claim 7 wherein said front panel being fastened to three spaced said support members, one said support member positioned at said proximal vertical edge, another said support member positioned at said distal vertical edge, a third said support member positioned midway of said panel.

11. The section of claim 7 wherein said section being arcuate, said front and back surface of said front panel being curved, and said front and rear side edges of said top plate being curved.

12. A modular service bar section kit comprising a plurality of spaced interchangeable U-shaped hollow box support members each having an inner wall and an outer wall and a pair of side walls juxtaposed to form said members, a rectangular front panel having a top horizontal edge, a bottom horizontal edge, a proximal vertical edge and a distal vertical edge, a plurality of spaced fasteners located laterally outwardly of said front panel for removably and rigidly affixing said front panel to said support members, said front panel having a front surface and a back surface, said back surface of said front panel being removably juxtaposed to said outer wall of said members, a rigid top plate having a top surface and a bottom surface, a front side edge and a rear side edge, connection means for detachably and rigidly affixing said plate to said support members, said connection means includes a pair of trim bands releasably attached to said outer wall of said members by fasteners and said fasteners supporting said front panel thereon, said panel being sandwiched between said outer side wall of said member and said bands, said bottom surface of said plate being removably attached to said outer wall of said members.

13. The bar section kit of claim 12 wherein each side member includes a lower horizontal box member, an elongated upright vertical box member and an upper horizontal box member, said upright member at its lower end being rigidly connected to said lower member, said upper member being rigidly connected to an upper end of said upright member, said outer wall of said lower member being disposable on a horizontal surface.

14. The bar section kit of claim 13 wherein each said support member includes a gusset positioned and affixed to and between said lower member and said upright member, and another gusset positioned and affixed to and between said upper member and said upright member.

15. The bar section kit of claim 13 wherein said upper member includes a pair of spaced knobs disposed and extending upwardly from said outer wall of said upper member, said top plate being detachably secured to said knobs.

16. The bar section kit of claim 12 wherein said section is arcuate, said front and back surface of said front panel being curved, and said front and rear side edges of said top plate being curved.

17. The bar section kit of claim 12 wherein said section includes one said front panel fastened to three spaced said support members, one said support member being located at said proximal vertical edge, another said support member being located at said distal vertical edge, a third said support member being positioned midway of said front panel and midway of said one and adjacent another of said support members.

18. The bar section of claim 17 wherein one said section being adjacent to another said section, one said support member at said proximal vertical edge of one said section being detachably coupled to one said support member at said distal vertical edge of another said section, and another said support member at said distal vertical edge of one said section being adapted to be detachably coupled to a further said support member at said proximal vertical edge of a further identical section.

19. A modular service bar comprising a plurality of coupleable interchangeable sections, each said section including a plurality of spaced U-shaped hollow box support members, each said support member having an outer wall, an inner wall and a pair of side walls juxtaposed to form a lower horizontal box member, and elongated upright vertical box member and an upper horizontal box member, said upright member at its lower end being rigidly connecting to said lower member, said upper member being rigidly connected to said lower member, said upper member being rigidly connected to an upper end of said upright member, a rectangular front panel for each section having a top horizontal edge, a bottom horizontal edge, a proximal vertical edge and a distal vertical edge, said panel generally overlying and covering said upright members, said front panel having a front surface and a back surface juxtaposed to said outer wall of said upright members, means for detachably and rigidly affixing said front panel to said upright members, a top plate having a top surface and a bottom surface juxtaposed to said outer wall of said upper member, said top plate being detachably and rigidly affixed to each said upper member.

20. The modular bar of claim 19 wherein one said section being adjacent to another said section, one said support member at said proximal vertical edge of one said section being detachably coupled to one said support member at said distal vertical edge of another said section, and another said support member at said distal vertical edge of one said section being adapted to be detachably coupled to a further said support member at said proximal vertical edge of a further identical section.

21. The modular bar of claim 19 wherein said plurality of sections form a substantially circular bar, each said top plate having inner and outer curved edges.

22. The modular bar of claim 19 wherein said means for detachably and rigidly affixing said front panel includes a pair of trim bands, one said trim band being disposed adjacent said bottom edge of said front panel and being fastened to said upright members without passing through said front panel, and another said trim band being disposed adjacent said top horizontal edge and being fastened to said upright members without passing through said front panel.

23. The modular bar of claim 19 wherein each said support member includes a gusset positioned and affixed to and between said lower member and said upright member, and another gusset positioned and affixed to and between said upper member and said upright member.

24. The modular bar of claim 19 wherein each said upper member includes a pair of knobs disposed and extending upwardly from said outer wall of said support member, said knobs supporting said top plate spacedly above said support member and said top plate being detachably and rigidly secured to said knobs.

* * * * *